US009340929B2

(12) United States Patent
Cox et al.

(10) Patent No.: US 9,340,929 B2
(45) Date of Patent: May 17, 2016

(54) COMPONENTS OF A RAILWAY RAIL FASTENING ASSEMBLY

(75) Inventors: Stephen John Cox, Richmond (GB); David Christopher Herron, Oxford (GB)

(73) Assignee: PANDROL LIMITED (GB)

( * ) Notice: Subject to any disclaimer, the term of this patent is extended or adjusted under 35 U.S.C. 154(b) by 269 days.

(21) Appl. No.: 14/113,538

(22) PCT Filed: Jun. 27, 2012

(86) PCT No.: PCT/GB2012/051504

§ 371 (c)(1), (2), (4) Date: Nov. 18, 2013

(87) PCT Pub. No.: WO2013/007980

PCT Pub. Date: Jan. 17, 2013

(65) Prior Publication Data

US 2014/0061323 A1 Mar. 6, 2014

(30) Foreign Application Priority Data

Jul. 12, 2011 (GB) ..... 1111907.0

(51) Int. Cl.
*E01B 9/30* (2006.01)

(52) U.S. Cl.
CPC .. *E01B 9/30* (2013.01); *E01B 9/306* (2013.01)

(58) Field of Classification Search
CPC ..... E01B 9/30; E01B 9/306
USPC ..... 238/351, 352
See application file for complete search history.

(56) References Cited

U.S. PATENT DOCUMENTS 6,343,748 B1 2/2002 Pilesi et al.
6,367,704 B1 4/2002 Mediavilla (Continued)

FOREIGN PATENT DOCUMENTS

WO WO 2009/004274 A1 1/2009
WO WO 2010/089668 A1 8/2010

OTHER PUBLICATIONS

Great Britain's Intellectual Property Office's Search Report under Section 17, dated Oct. 24, 2011, corresponding to Application No. GB1111907.0.

(Continued)

*Primary Examiner* — Zachary Kuhfuss
(74) *Attorney, Agent, or Firm* — Husch Blackwell LLP

(57) ABSTRACT

An anchoring device for use in a railway rail fastening assembly which employs a resilient railway rail fastening clip to fasten a railway rail, comprises a body having a front portion which is configured to provide a first load bearing surface extending alongside the rail foot when the device is in use, and first and second side faces respectively located on opposite sides of the body and configured to extend transversely away from the first portion. The device comprises first and second projecting portions, the first projecting portion extending outwardly from the first side face of the body and providing a first additional load bearing surface which is set back from the first load bearing surface, and the second projecting portion extending outwardly from the second side face of the body and providing a second additional load bearing surface which is set back from the first load bearing surface.

31 Claims, 5 Drawing Sheets

(56) References Cited

U.S. PATENT DOCUMENTS

| | | | | |
|---|---|---|---|---|
| 2003/0080195 | A1 | 5/2003 | Mediavilla | |
| 2007/0138311 | A1 | 6/2007 | Young | |
| 2008/0203181 | A1* | 8/2008 | Young | E01B 9/303 238/351 |
| 2012/0031992 | A1* | 2/2012 | Mediavilla | E01B 9/30 238/351 |
| 2012/0187203 | A1* | 7/2012 | Cox | E01B 9/303 238/84 |

OTHER PUBLICATIONS

European Patent Office's International Search Report, dated Nov. 13, 2012, corresponding to International Application No. PCT/GB2012/051504.

* cited by examiner

COMPONENTS OF A RAILWAY RAIL FASTENING ASSEMBLY

The present invention relates to components of a railway rail fastening assembly.

Generally railway rail fastening assemblies for fastening railway rails comprise two anchoring devices secured to a concrete railway rail sleeper or tie such that there is an anchoring device on each side of the rail seat area. The anchoring devices may be configured to retain respective resilient railway rail fastening clips in a configuration in which the clips bear on a foot of the railway rail when the rail is located adjacent to the anchoring device. In such cases, plastic sidepost insulators, for electrically insulating the anchoring devices from the rail, may be provided on each anchoring device so that a load bearing face of the sidepost insulator lies between the anchoring device and the rail foot.

Plastic sidepost insulators are subject to wear, and the rate of wear in areas where the track curves tightly may be higher than is desirable. However, these tight curves may constitute only a very small percentage of the areas where sleepers are used, so it is desirable to provide a solution to the wear problem which does not add significant extra cost into the assembly used in other areas of the track. For example, it is undesirable to provide a wider bearing area for the sidepost insulator by making the anchoring device bigger and wider overall, because of the additional cost of the anchoring devices. In addition, new patterns would be needed to make such anchoring devices and significant modification would be required to existing concrete sleeper moulds to accommodate anchoring devices with a bigger "footprint".

One way of providing a wider bearing area was proposed by the present applicants in WO2010/116118, where it is suggested that concrete upstands are built up on either side of the rail seat area to give an additional face against which lateral loads can be reacted, but this proposal requires a modification of existing sleeper moulds and in particular a more complex mould shape, making moulding sleepers more difficult.

According to an embodiment of a first aspect of the present invention there is provided an anchoring device, for use in a railway rail fastening assembly which employs a resilient railway rail fastening clip to fasten a railway rail, the device being configured to retain such a resilient railway rail fastening clip in a configuration in which the clip bears on a foot of the railway rail when located adjacent to the anchoring device when the device is in use, the device comprising a body having a front portion, which is configured to provide a first load bearing surface which extends alongside the rail foot when the device is in use, and first and second side faces respectively located on opposite sides of the body and configured to extend transversely away from the first portion, wherein the device further comprises first and second projecting portions, the first projecting portion extending outwardly from the first side face of the body, the first projecting portion providing a first additional load bearing surface which is set back from the first load bearing surface, and the second projecting portion extending outwardly from the second side face of the body, the second projecting portion providing a second additional load bearing surface which is set back from the first load bearing surface.

In an anchoring device embodying the present invention each of the first and second projecting portions may extend to the uppermost edge of the side face from which it extends.

An anchoring device embodying the present invention preferably further comprises first and second ledge portions, the first ledge portion extending outwardly from the first side face of the body and the second ledge portion extending outwardly from the second side face of the body, the first ledge portion extending from the first additional load bearing surface towards the first load bearing surface and providing a first support surface, and the second ledge portion extending from the second additional load bearing surface towards the first load bearing surface and providing a second support surface.

In such an anchoring device, one or each of the first and second ledge portions may extend to the first load bearing surface.

In such an anchoring device, one or each of the first and second ledge portions may extend from its associated additional load bearing surface at a lowermost edge thereof.

Such an anchoring device may further comprise additional ledge portions which extend around, and project outwardly from the lowermost edge of, at least part of the first ledge portion and the second ledge portion.

In an anchoring device embodying the present invention the first load bearing surface, the first additional load bearing surface and the second additional load bearing surface may be substantially parallel to one another.

In an anchoring device embodying the present invention each of the first and second projecting portions may further comprise a face, on the opposite side of the projecting portion to the additional load bearing surface, which provides an abutment surface.

In an anchoring device embodying the present invention the first and second additional load bearing surfaces may be configured to interact with corresponding surfaces on another component of the rail fastening assembly.

In an anchoring device embodying the present invention the first and second projecting portions may be configured to interlock with mating features on the said component. In such an anchoring device the first and second ledge portions may be configured to support the said component and, if provided, the additional ledge portions may also be configured to support the said component.

According to an embodiment of a second aspect of the present invention there is provided a component for use in a railway rail fastening assembly which employs an anchoring device for retaining a railway rail fastening clip, the component comprising first and second sections providing respective first and second auxiliary load bearing surfaces, and a third section interconnecting respective parts of the first and second sections so that the first and second sections are spaced apart whereby the component can be mounted on such an anchoring device such that the first and second sections are on opposite sides thereof, the front parts of each of the first and second sections having respective rear contact faces, opposite to the auxiliary load bearing surface thereof, for contacting a load bearing face of the anchoring device when mounted thereon In a component embodying the present invention the front parts of each of the first and second sections may further comprise respective bottom contact faces for contacting a support surface on the anchoring device.

In a component embodying the present invention the third section may be connected to the first and second sections at parts thereof which are spaced from the auxiliary load bearing surfaces.

In a component embodying the present invention, in each of the first and second sections, the rear contact face may define one wall of a slot provided in that section for engaging a mating feature on the anchoring device. Uppermost ends of the slots may be closed, in order to strengthen the component.

In a component embodying the present invention the thickness of the first and second sections may be greater at the auxiliary load bearing surface thereof than at the parts connected to the third section.

According to an embodiment of a third aspect of the present invention there is provided apparatus for use in a railway rail fastening assembly, the apparatus comprising an anchoring device configured to retain a resilient railway rail fastening clip in a configuration in which the clip bears on a foot of the railway rail when located adjacent to the anchoring device when the device is in use, wherein the anchoring device is a device embodying the first aspect of the present invention and the assembly further comprises a component embodying the second aspect of the present invention, wherein the component is configured so as to be mountable on the said anchoring device such that the first and second sections of the component lie respectively on opposite sides of the body of the device alongside respective side faces thereof, and the rear contact faces of the first and second auxiliary load bearing surfaces contact the first and second additional load bearing surfaces of the device respectively.

In apparatus embodying the third aspect of the present invention, when the component embodying the second aspect of the present invention has bottom contact faces, the component may be configured so as to be mountable on the said anchoring device such that the bottom contact faces of the first and second sections of the component are preferably in contact with the first and second support surfaces of the device.

In apparatus embodying the third aspect of the present invention, when the component embodying the second aspect of the present invention is provided with slots, the slots of the first and second sections may be shaped and arranged to receive therein the first and second projecting portions of the anchoring device respectively. An uppermost face of the anchoring device body and an uppermost face of the component preferably lie in approximately the same plane. In this case, if uppermost ends of the slots are closed, the first and second projecting portions do not extend to the uppermost edges of the side faces from which they extend.

In such apparatus, the anchoring device and component are preferably shaped and arranged such that, when the component is mounted on the anchoring device the first load bearing surface of the anchoring device and the first and second auxiliary load bearing surfaces of the component lie substantially in the same plane.

By virtue of the component mounted on the anchoring device, the first load bearing surface of the anchoring device is effectively elongated by the length of the first and second auxiliary load bearing surfaces, which are arranged to transfer load into the anchoring device through contact with the additional load bearing surfaces on the anchoring device against which they press when loaded by the rail edge.

It is therefore envisaged that anchoring devices embodying the first aspect of the present invention will be provided at every anchoring position on all sleepers to be supplied to a particular location, but only anchoring devices on the field side of the sleeper at tight curves which require a longer load bearing face will be provided with a component embodying the second aspect of the present invention and an elongate sidepost insulator which sits between the anchoring device/component and the rail foot and has a much wider load bearing face than the standard side post insulators used elsewhere on the track.

A benefit of this idea is that it is relatively easy to implement and does not require significant modification of the moulds used to make the concrete sleepers. Moreover, as the extra component and wider sidepost insulator will only need to be fitted on sleepers destined for curves, or will be retrofitted on site on curves if necessary, there is no significant cost impact on the majority of sleepers.

Preferably, but not necessarily, the anchoring device of the present invention has the same 'footprint' when viewed from above as a prior art anchoring device, so that it will still fit into existing unmodified sleeper mould pockets.

Optionally, the size of the first and second projecting portions can be increased by removing material from the outer edges of the front face of the shoulder. This increases the bearing where the component is used, at the expense of reducing it where it is not.

If the sleeper is slightly skewed, as is often the case, such that one side of the component will be loaded preferentially over the other, then the component will tend to rotate relative to the anchoring device and lock off against it, transferring load into the side wall of the anchoring device.

Reference will now be made, by way of example, to the accompanying drawings, in which.

Figure 1:
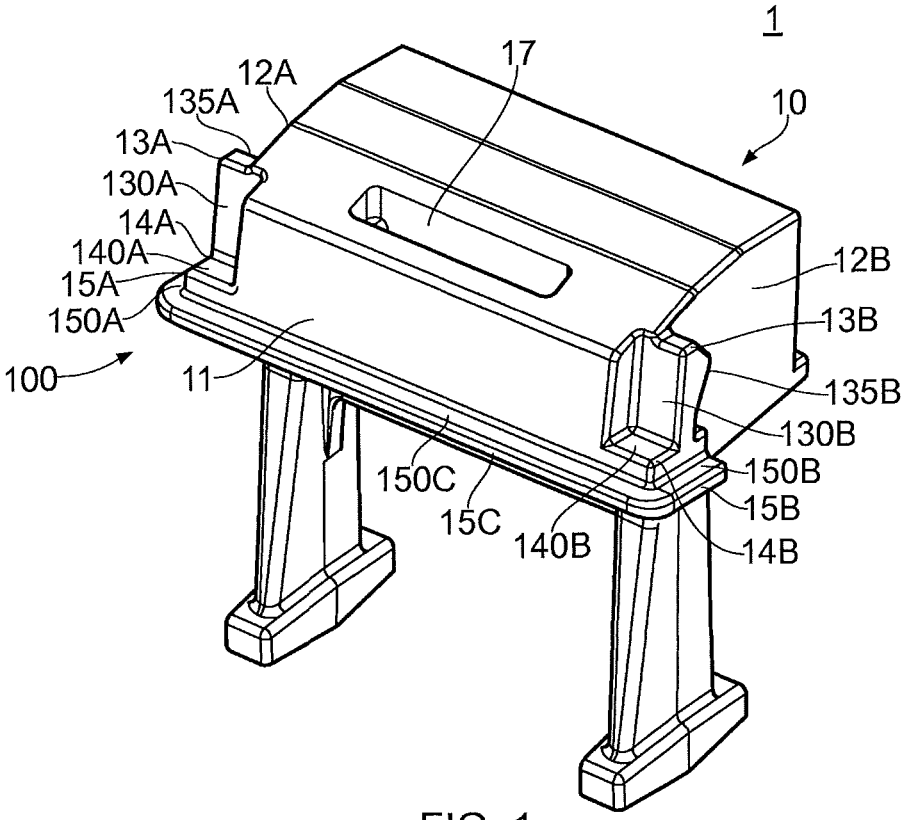
FIG. 1 shows a front perspective view of a first anchoring device embodying the first aspect of the present invention.

FIG. 1 shows a cast metal anchoring device 1, for use in a railway rail fastening assembly which employs a resilient railway rail fastening clip (not shown) to fasten a railway rail (not shown), the device being configured to retain such a resilient railway rail fastening clip in a configuration in which the clip bears on a foot of the railway rail when located adjacent to the anchoring device when the device is in use. The anchoring device 1 comprises a body 10 having a front portion 100, which is configured to provide a first load bearing surface 11 which extends alongside the rail foot when the device is in use, and first and second side faces 12A, 12B respectively located on opposite sides of the body 10 and configured to extend transversely away from the first portion 100. The anchoring device further comprises first and second projecting portions 13A, 13B and first and second ledge portions 14A, 14B. The first projecting portion 13A and the first ledge portion 14A extend outwardly from the first side face 12A of the body 10. The first projecting portion 13A provides a first additional load bearing surface 130A which is set back from the first load bearing surface 11. The first projecting portion 13A extends to the uppermost edge of the first side face 12A. The first ledge portion 14A extends from a lowermost edge of the first additional load bearing surface 130A to the first load bearing surface 11 and provides a first support surface 140A. The second projecting portion 13B and the second ledge portion 14B extend outwardly from the second side face 12B of the body 10. The second projecting portion 13B provides a second additional load bearing surface 130B which is set back from the first load bearing surface 11 (by an equal amount in this embodiment to the first additional load bearing surface 130A, but this need not be the case). In this embodiment, the first additional load bearing surface 130A and the second additional load bearing surface 130B are substantially parallel to one another and to the first load bearing surface 11. The second projecting portion 13B extends to the uppermost edge of the second side face 12B. The second ledge portion 14B extends from a lowermost edge of the second additional load bearing surface 130B to the first load bearing surface 11 and provides a second support surface 140B. The anchoring device 1 further comprises additional ledge portions 15A, 15B which extend around, and project outwardly from a lowermost edge of, at least part of the first ledge portion 14A and the second ledge portion 14B and provide respective additional support surfaces 150A, 150B. The additional ledge portions 15A, 15B are contiguous with another additional ledge portion 15C which extends along, and projects outwardly from a lowermost edge of the first load bearing surface 11 and provides another additional support surface 150C. Each of the first and second projecting portions 13A, 13B further comprises a face 135A, 135B, on the opposite side of the projecting portion 13A, 13B to the additional load bearing surface 130A, 130B, which provides an abutment surface.

In this embodiment, in which the anchoring device 1 is of the type designed to retain a resilient rail fastening clip formed of a metal plate bent so as to have a C-shaped profile, the anchoring device 1 has a cavity 16 (see FIG. 3B), open to the rear of the device, for receiving the base of such a clip. A throughhole 17 is provided in the roof of the cavity 16 in this embodiment, but is not essential to the invention.

The first and second additional load bearing surfaces 130A, 130B are configured to interact with corresponding surfaces on another component, a collar 2, described below. The first and second projecting portions 13A, 13B are configured to interlock with mating features on collar 2, the first and second ledge portions 14A,14B are configured to support the collar 2, and the additional ledge portions 15A, 15B are configured to support the collar 2.

Figure 2:
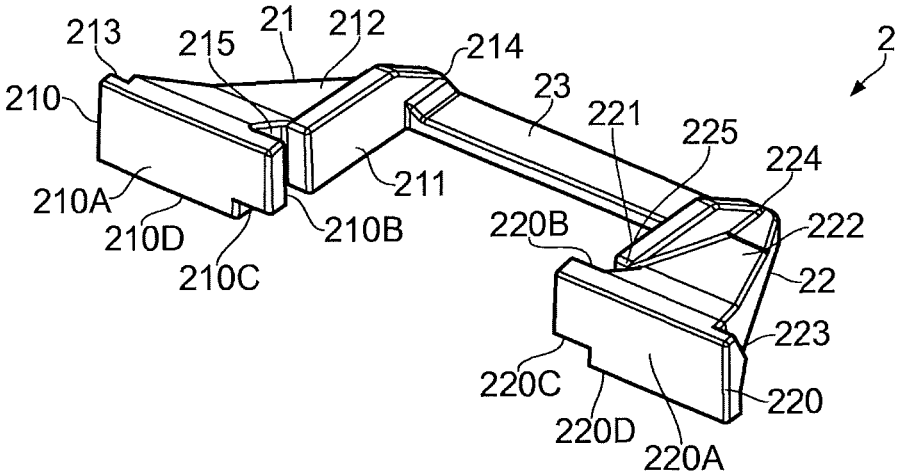
FIG. 2 shows a front perspective view of a first component embodying the second aspect of the present invention.

As shown in FIG. 2 the collar 2, which is preferably made from cast metal, comprises first and second sections 21, 22 each having a front part 210, 220, the front parts 210, 220 providing respective first and second auxiliary load bearing surfaces 210A, 220A, and a third section 23 interconnecting respective parts of the first and second sections 21, 22 so that the first and second sections 21, 22 are spaced apart, whereby the collar 2 can be mounted on the anchoring device 1 such that the first and second sections 21, 22 are on opposite sides thereof. The third section 23 is connected to the first and second sections 21, 22 at rear parts 214, 224 thereof which are spaced from the auxiliary load bearing surfaces 210A, 220A. The front and rear parts 210, 214 of the first section 21 are connected together by a side wall 211 and a web of material 212. The front and rear parts 220, 224 of the second section 22 are connected together by a side wall 221 and a web of material 222. At the outermost ends of the front parts 210, 220 there are provided respective locating features 213, 223 for use in locating a sidepost insulator (shown in FIGS. 4, 5A and 5B). The front parts 210, 220 of each of the first and second sections 21, 22 have respective rear contact faces 210B, 220B, opposite to the auxiliary load bearing surface 210A, 220A thereof, for contacting the first and second additional load bearing surfaces 130A, 130B of the anchoring device 1 when mounted thereon. The front parts 210, 220 of each of the first and second sections 21, 22 further comprise respective bottom contact faces 210C, 220C for contacting the first and second support surfaces 140A, 140B of the anchoring device 1 respectively, and further bottom contact faces 210D, 220D for contacting the additional support surfaces 150A, 150B of the anchoring device 1 respectively. In each of the first and second sections 21, 22, the rear contact face 210B, 220B defines one wall of a slot 215, 225 provided in that section 21, 22 for engaging a mating feature on the anchoring device, i.e. for receiving respective ones of the first and second projecting portions 13A, 13B. The walls of the slot 215, 225 which are opposite to the rear contact face 210B, 220B are provided by respective end faces of the side walls 211, 221.

The width of the collar 2 decreases from the front to the rear of the collar 2, i.e. from the auxiliary load bearing surfaces 210A, 220A at the front of the first and second sections 21, 22 to the third section 23. The thickness of the web of material 212, 222 of the first and second sections 21, 22 is greater at the front than at the rear of the collar 2, the thickness of the material tapering gradually from the auxiliary load bearing surface 210A, 220A to the rear part 214, 224 connected to the third section 23.

Figure 3A:
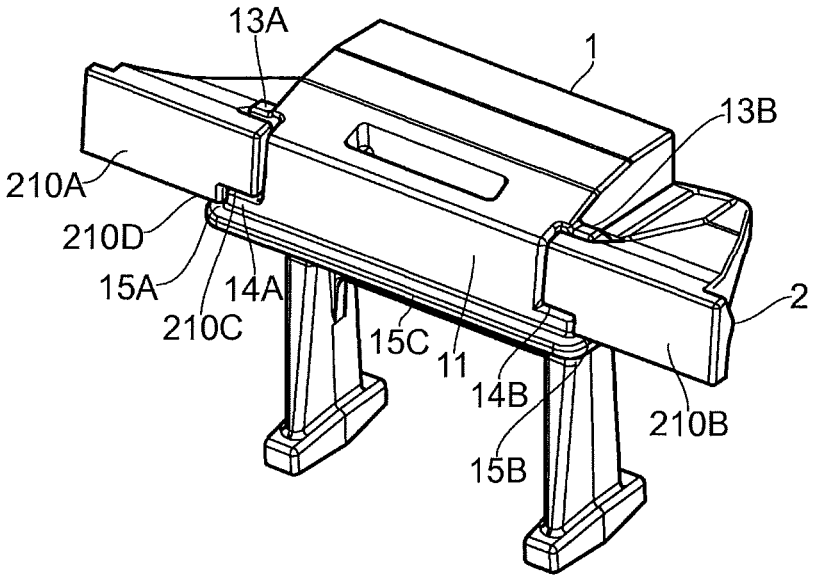
FIGS. 3A and 3B show respective front and rear perspective views of a first apparatus embodying the third aspect of the present invention.
Figure 3B:
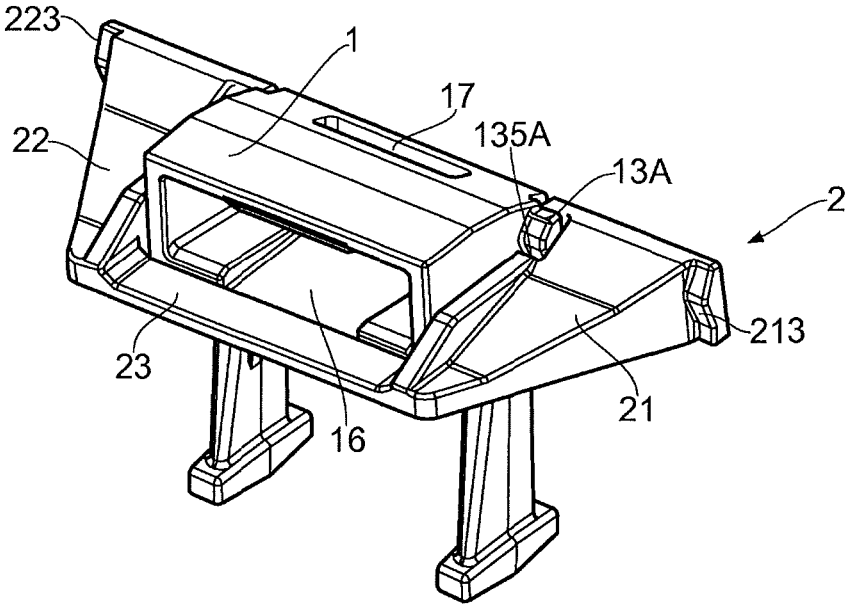

As shown in FIGS. 3A and 3B apparatus for use in a railway rail fastening assembly includes the anchoring device of FIG. 1 and the collar 2 of FIG. 2. The collar 2 is configured so as to be mountable on the anchoring device 1 such that the first and second sections of the collar 2 lie respectively on opposite sides of the body 10 of the device 1 alongside respective side faces 12A, 12B thereof, the rear contact faces 210B, 220B of the front parts 210, 220 of the first and second sections 21, 22 contact the first and second additional load bearing surfaces 130A, 130B of the device 1 respectively, the bottom contact faces 210C, 220C of the front parts 210, 220 of the first and second sections 21, 22 are in contact with the first and second support surfaces 140A, 140B of the device, and the further bottom contact faces 210D, 220D are in contact with the additional support surfaces 150A, 150B of the device. In this embodiment the anchoring device 1 and collar 2 are shaped and arranged such that the first load bearing surface 11 of the anchoring device 1 and the first and second auxiliary load bearing surfaces 210A, 220A of the collar 2 lie substantially in the same plane, but this configuration is not essential. The slots 215, 225 of the first and second sections 21, 22 are shaped and arranged to receive therein the first and second projecting portions 13A, 13B of the anchoring device 1 respectively.

By virtue of the collar 2 mounted on the anchoring device 1, the first load bearing surface 11 of the anchoring device is effectively elongated by the length of the first and second auxiliary load bearing surfaces 210A, 220B, which are arranged to transfer load into the anchoring device 1 through contact with the additional load bearing surfaces 130A, 130B on the anchoring device 1.

Figure 4:
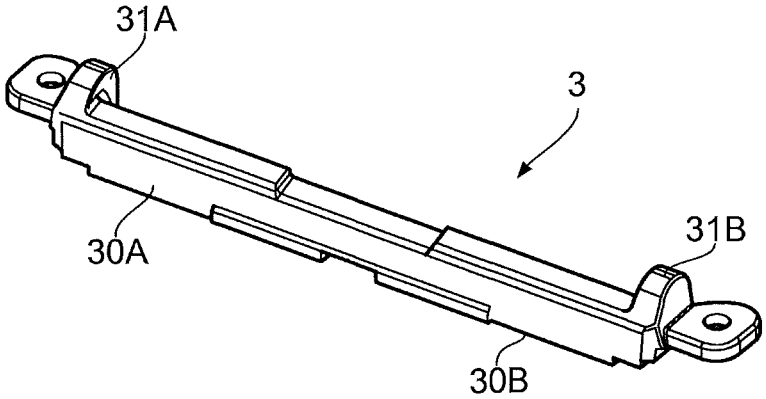
FIG. 4 shows a front perspective view of a sidepost insulator forming an additional part of apparatus embodying the third aspect of the present invention.
Figure 5A:
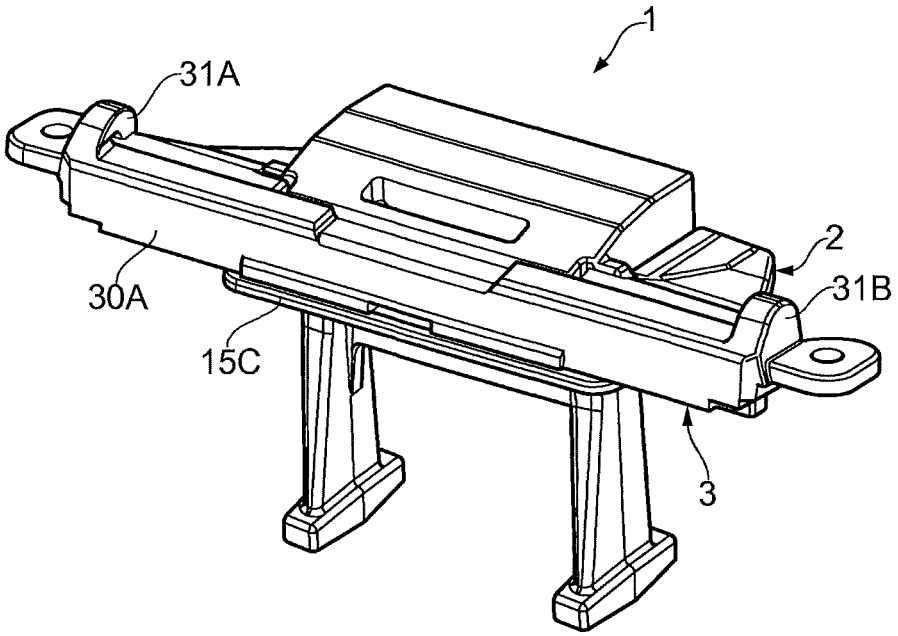
FIGS. 5A and 5B show respective front and rear perspective views of the apparatus of FIGS. 3A and 3B including the additional part shown in FIG. 4.
Figure 5B:
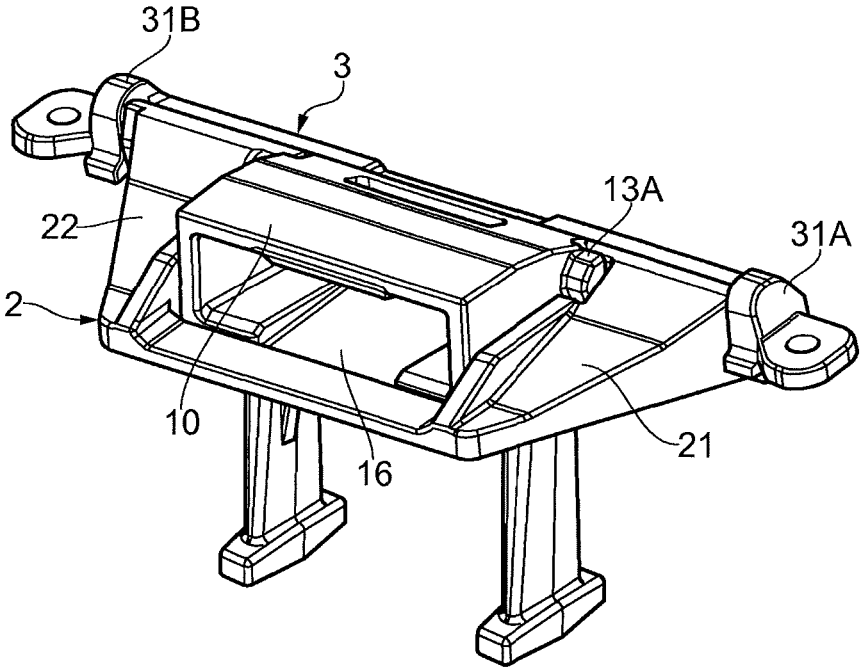

This permits the use of a longer sidepost insulator with the anchoring device 1, as shown in FIG. 4, which shows the sidepost insulator 3 alone, and FIGS. 5A and 5B, which show the sidepost insulator 3 in combination with the anchoring device 1 and collar 2. The sidepost insulator 3 has an elongate load bearing face 30A and a bottom contact face 30B. The sidepost insulator 3 can be retained on the collar 2 by means of locating portions 31A, 31B which are adjacent to the two ends of the insulator 3 and are arranged to engage the parts 213, 223 of the collar 2. The bottom contact face 30B rests on the additional support surface 150C of the anchoring device 1. A rear face of the insulator, opposite to the elongate load bearing face 30A, abuts the first load bearing surface 11 of the anchoring device 1 and the auxiliary load bearing surfaces 210A, 220A of the collar 2.

The abutment surfaces 135A, 135B on the anchoring device are provided to cooperate with corresponding features on a standard-length sidepost insulator (not shown) which is fitted to the anchoring device 1 when an extended sidepost insulator is not required and hence a collar 2 is not mounted on the device 1.

Figure 6:
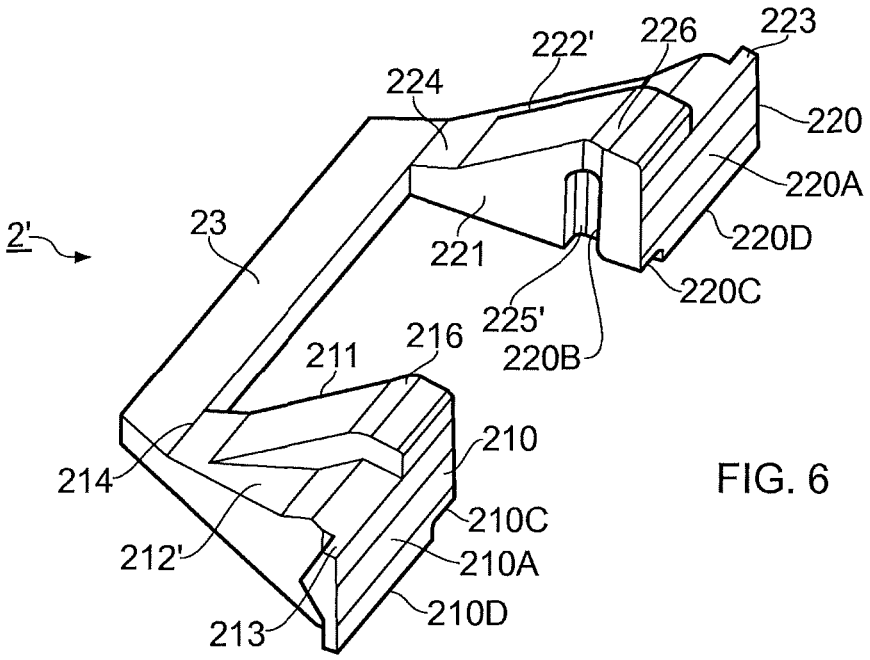
FIG. 6 shows a front perspective view of a second component embodying the present invention.
Figure 7:
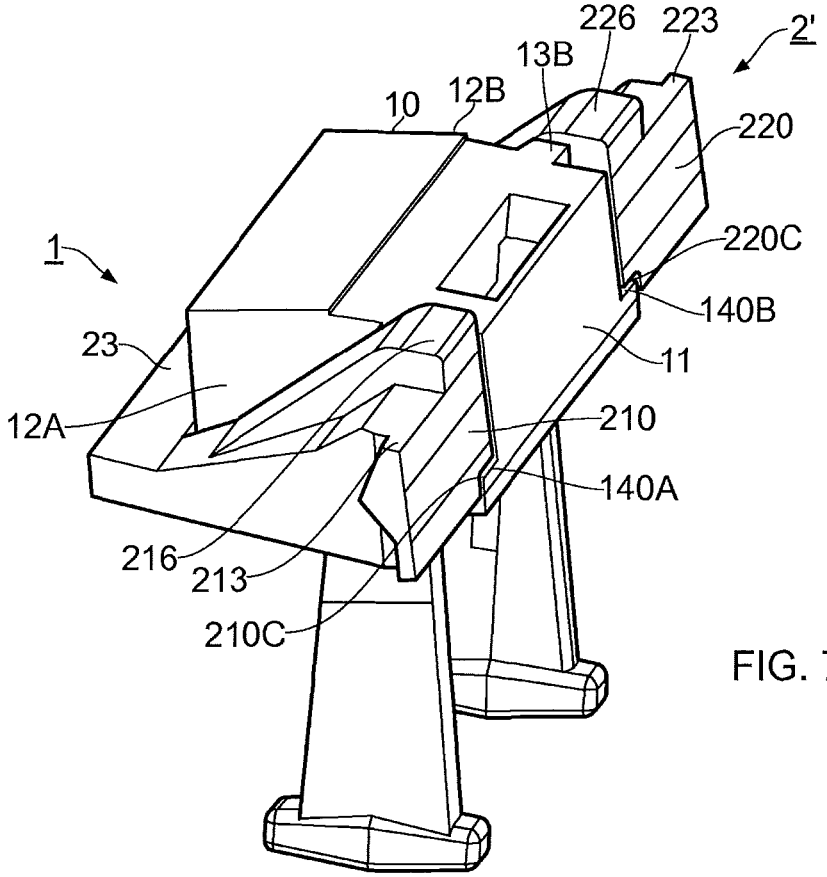
FIG. 7 shows a front perspective view of apparatus embodying the third aspect of the present invention which comprises the component of FIG. 6 and an anchoring device embodying the first aspect of the present invention.

A second collar 2' embodying the second aspect of the present invention is shown in FIG. 6. The collar 2' is shown in FIG. 7 in apparatus embodying the third aspect of the present invention together with an anchoring device 1 embodying the first aspect of the present invention. Where the parts of the collar 2' are the same as those of the collar 2, these are denoted by the same reference numerals.

The collar 2', which is preferably made from cast metal, comprises first and second sections 21, 22 each having a front part 210, 220, the front parts 210, 220 providing respective first and second auxiliary load bearing surfaces 210A, 220A, and a third section 23 interconnecting respective parts of the first and second sections 21, 22 so that the first and second sections 21, 22 are spaced apart, whereby the collar 2 can be mounted on an anchoring device 1 (see FIG. 7) such that the first and second sections 21, 22 are on opposite sides thereof. The third section 23 is connected to the first and second sections 21, 22 at rear parts 214, 224 thereof which are spaced from the auxiliary load bearing surfaces 210A, 220A. The front and rear parts 210, 214 of the first section 21 are connected together by a side wall 211 and a web of material 212'. The front and rear parts 220, 224 of the second section 22 are connected together by a side wall 221 and a web of material 222'. At the outermost ends of the front parts 210, 220 there are provided respective locating features 213, 223 for use in locating a sidepost insulator (such as that shown in FIGS. 4, 5A and 5B). The front parts 210, 220 of each of the first and second sections 21, 22 have respective rear contact faces 210B, 220B, opposite to the auxiliary load bearing surface 210A, 220A thereof, for contacting the first and second additional load bearing surfaces 130A, 130B of the anchoring device 1 when mounted thereon. The front parts 210, 220 of each of the first and second sections 21, 22 further comprise respective bottom contact faces 210C, 220C for contacting the first and second support surfaces 140A, 140B of the anchoring device 1 respectively, and further bottom contact faces 210D, 220D for contacting the additional support surfaces 150A, 150B of the anchoring device 1 respectively. In each of the first and second sections 21, 22, the rear contact face 210B, 220B defines one wall of a slot 215', 225' provided in that section 21, 22 for engaging a mating feature on the anchoring device, i.e. for receiving respective ones of first and second projecting portions 13A, 13B. The walls of the slot 215', 225' which are opposite to the rear contact faces 210B, 220B are provided by respective end faces of the side walls 211, 221. Unlike the first collar 2, the slots 215', 225' of the second collar 2' are closed off at respective uppermost ends thereof by parts 216, 226 which partially overlie the side walls 211, 221 and portions 212', 222' and strengthen the collar 2'.

Although not shown in the Figures, a third collar could be provided which is reduced in height, compared to the collar 2', to approximately that of the collar 2 whilst still having material over the top of the slots which receive an anchoring device. In this case the slots in the collar may be shorter as compared to the first collar 2 and if so it will also be necessary to provide an anchoring device embodying the present invention in which the height of the first and second projecting portions which project from the side faces of the anchoring device is reduced as compared to the first anchoring device 1, i.e. to provide a second anchoring device in which the first and second projecting portions of the second anchoring device do not extend to the uppermost edges of the side faces.

Although the embodiments have been described with reference to an anchoring device of the type designed to retain a resilient rail fastening clip formed of a metal plate bent so as to have a C-shaped profile, the invention can be applied to other forms of anchoring device designed for fastening assemblies in which the clip is driven onto the rail in a direction substantially perpendicular to the rail or to anchoring devices designed for fastening assemblies in which the clip is driven onto the rail in a direction substantially parallel to the rail.

The invention claimed is:

1. An anchoring device, for use in a railway rail fastening assembly which employs a resilient railway rail fastening clip to fasten a railway rail, the device being configured to retain such a resilient railway rail fastening clip in a configuration in which the clip bears on a foot of the railway rail when located adjacent to the anchoring device when the device is in use, the device comprising a body having a front portion, which is configured to provide a first load bearing surface which extends alongside the rail foot when the device is in use, and first and second side faces respectively located on opposite sides of the body and configured to extend transversely away from the first portion, wherein the device further comprises:

first and second projecting portions, the first projecting portion extending outwardly from the first side face of the body and, providing a first additional load bearing surface which is set back from the first load bearing surface, and the second projecting portion extending outwardly from the second side face of the body and, providing a second additional load bearing surface which is set back from the first load bearing surface; and first and second ledge portions, the first ledge portion extending outwardly from the first side face of the body and the second ledge portion extending outwardly from the second side face of the body, the first ledge portion extending from the first additional load bearing surface to the first load bearing surface and providing a first support surface, and the second ledge portion extending from the second additional load bearing surface to the first load bearing surface and providing a second support surface, wherein each of the first and second projecting portions further comprise a face, on an opposite side of the projecting portion to the additional load bearing surface, which provides an abutment surface.

2. A device as claimed in claim 1, wherein one or each of the first and second projecting portions extends to the uppermost edge of the side face from which the respective first or second projecting portion extends.

3. A device as claimed in claim 1, wherein one or each of the first and second ledge portions extends from the respective first or second ledge portion's associated additional load bearing surface at a lowermost edge thereof.

4. A device as claimed in claim 1, further comprising additional ledge portions which extend around, and project outwardly from the lowermost edge of, at least part of the first ledge portion and the second ledge portion.

5. A device as claimed in claim 1, wherein the first load bearing surface, the first additional load bearing surface and the second additional load bearing surface are substantially parallel to one another.

6. A device as claimed in claim 1, wherein the first and second additional load bearing surfaces are configured to interact with corresponding surfaces on another component of the rail fastening assembly.

7. A device as claimed in claim 6, wherein the first and second projecting portions are configured to interlock with mating features on the said component.

8. A device as claimed in claim 6, wherein the first and second ledge portions are configured to support the said component.

9. A device as claimed in claim 6, further comprising additional ledge portions which extend around, and project outwardly from the lowermost edge of, at least part of the first ledge portion and the second ledge portion, wherein the additional ledge portions are configured to support the said component.

10. Apparatus for use in a railway rail fastening assembly, the apparatus comprising:

an anchoring device configured to retain a resilient railway rail fastening clip in a configuration in which the clip bears on a foot of the railway rail when located adjacent to the anchoring device when the device is in use, wherein the anchoring device comprises a body having a front portion, which is configured to provide a first load bearing surface which extends alongside the rail foot when the device is in use, first and second side faces respectively located on opposite sides of the body and configured to extend transversely away from the first portion, and first and second projecting portions, wherein the first projecting portion extends outwardly from the first side face of the body and provides a first additional load bearing surface which is set back from the first load bearing surface, and the second projecting portion extends outwardly from the second side face of the body and provides a second additional load bearing surface which is set back from the first load bearing surface, and a component comprising first and second sections each having a front part, the front parts providing respective first and second auxiliary load bearing surfaces, and a third section interconnecting respective rear parts of the first and second sections so that the first and second sections are spaced apart whereby the component can be mounted on the anchoring device such that the first and second sections lie respectively on opposite sides of the body of the device alongside respective side faces thereof, the front parts of each of the first and second sections having respective rear contact faces, opposite to the auxiliary load bearing surface thereof, for contacting the first and second additional load bearing faces of the anchoring device when mounted thereon, wherein each of the first and second sections of the component is provided with a slot, the rear contact face of that section defining one wall of the slot, and the slots of the first and second sections are shaped and arranged to receive therein the first and second projecting portions of the anchoring device respectively.

11. Apparatus as claimed in claim 10, wherein the front parts of each of the first and second sections of the component further comprise respective bottom contact faces for contacting a support surface on the anchoring device and the component is configured so as to be mountable on the said anchoring device such that the bottom contact faces of the first and second sections are in contact with the first and second support surfaces of the device.

12. Apparatus as claimed in claim 11, wherein the anchoring device further comprises first and second ledge portions for supporting the component, the first ledge portion extending outwardly from the first side face of the body and the second ledge portion extending outwardly from the second side face of the body, the first ledge portion extending from the first additional load bearing surface to the first load bearing surface and providing the first support surface, and the second ledge portion extending from the second additional load bearing surface to the first load bearing surface and providing a second support surface.

13. Apparatus as claimed in claim 12, wherein one or each of the first and second ledge portions extends from the respective first or second ledge portion's associated additional load bearing surface at a lowermost edge thereof.

14. Apparatus as claimed in claim 12, wherein the anchoring device further comprises additional ledge portions which extend around, and project outwardly from the lowermost edge of, at least part of the first ledge portion and the second ledge portion, which additional ledge portions are configured to support the said component.

15. Apparatus as claimed in claim 10, further comprising an electrical insulator having an elongate load bearing part, one face of the load bearing part providing a load bearing face and an opposite face of the load bearing part providing a rear contact face, wherein the insulator is configured to be located on the component in an arrangement in which the rear contact face of the load bearing part abuts the first load bearing surface of the anchoring device and the first and second auxiliary load bearing surfaces of the component.

16. Apparatus as claimed in claim 10, wherein the third section of the component is connected to the first and second sections at parts thereof which are spaced from the auxiliary load bearing surfaces.

17. Apparatus as claimed in claim 10, wherein the thickness of the first and second sections of the component is greater at the auxiliary load bearing surface thereof than at the parts connected to the third section.

18. Apparatus as claimed in claim 10, wherein one or each of the first and second projecting portions of the anchoring device extends to the uppermost edge of the side face from which the respective first or second projecting portion extends.

19. Apparatus as claimed in claim 10, wherein the first load bearing surface, the first additional load bearing surface and the second additional load bearing surface of the anchoring device are substantially parallel to one another.

20. Apparatus as claimed in claim 10, wherein each of the first and second projecting portions of the anchoring device further comprise a face, on an opposite side of the projecting portion to the additional load bearing surface, which provides an abutment surface.

21. Apparatus for use in a railway rail fastening assembly, the apparatus comprising:

an anchoring device configured to retain a resilient railway rail fastening clip in a configuration in which the clip bears on a foot of the railway rail when located adjacent to the anchoring device when the device is in use, wherein the anchoring device comprises a body having a front portion, which is configured to provide a first load bearing surface which extends alongside the rail foot when the device is in use, first and second side faces respectively located on opposite sides of the body and configured to extend transversely away from the first portion, and first and second projecting portions, wherein the first projecting portion extends outwardly from the first side face of the body and provides a first additional load bearing surface which is set back from the first load bearing surface, and the second projecting portion extends outwardly from the second side face of the body and provides a second additional load bearing surface which is set back from the first load bearing surface, and a component comprising first and second sections each having a front part, the front parts providing respective first and second auxiliary load bearing surfaces, and a third section interconnecting respective rear parts of the first and second sections so that the first and second sections are spaced apart whereby the component can be mounted on the anchoring device such that the first and second sections lie respectively on opposite sides of the body of the device alongside respective side faces thereof, the front parts of each of the first and second sections having respective rear contact faces, opposite to the auxiliary load bearing surface thereof, for contacting the first and second additional load bearing faces of the anchoring device when mounted thereon, wherein the anchoring device and component are shaped and arranged such that, when the component is mounted on the anchoring device the first load bearing surface of the anchoring device and the first and second auxiliary load bearing surfaces of the component lie substantially in the same plane.

22. Apparatus as claimed in claim 21, wherein the front parts of each of the first and second sections of the component further comprise respective bottom contact faces for contacting a support surface on the anchoring device and the component is configured so as to be mountable on the said anchoring device such that the bottom contact faces of the first and second sections are in contact with the first and second support surfaces of the device.

23. Apparatus as claimed in claim 22, wherein the anchoring device further comprises first and second ledge portions for supporting the component, the first ledge portion extending outwardly from the first side face of the body and the second ledge portion extending outwardly from the second side face of the body, the first ledge portion extending from the first additional load bearing surface to the first load bearing surface and providing the first support surface, and the second ledge portion extending from the second additional load bearing surface to the first load bearing surface and providing a second support surface.

24. Apparatus as claimed in claim 23, wherein one or each of the first and second ledge portions extends from the respective first or second ledge portion's associated additional load bearing surface at a lowermost edge thereof.

25. Apparatus as claimed in claim 23, wherein the anchoring device further comprises additional ledge portions which extend around, and project outwardly from the lowermost edge of, at least part of the first ledge portion and the second ledge portion, which additional ledge portions are configured to support the said component.

26. Apparatus as claimed in claim 21, comprising an electrical insulator having an elongate load bearing part, one face of the load bearing part providing a load bearing face and an opposite face of the load bearing part providing a rear contact face, wherein the insulator is configured to be located on the component in an arrangement in which the rear contact face of the load bearing part abuts the first load bearing surface of the anchoring device and the first and second auxiliary load bearing surfaces of the component.

27. Apparatus as claimed in claim 21, wherein the third section of the component is connected to the first and second sections at parts thereof which are spaced from the auxiliary load bearing surfaces.

28. Apparatus as claimed in claim 21, wherein the thickness of the first and second sections of the component is greater at the auxiliary load bearing surface thereof than at the parts connected to the third section.

29. Apparatus as claimed in claim 21, wherein one or each of the first and second projecting portions of the anchoring device extends to the uppermost edge of the side face from which the respective first or second projecting portion extends.

30. Apparatus as claimed in claim 21, wherein the first load bearing surface, the first additional load bearing surface and the second additional load bearing surface of the anchoring device are substantially parallel to one another.

31. Apparatus as claimed in claim 21, wherein each of the first and second projecting portions of the anchoring device further comprise a face, on an opposite side of the projecting portion to the additional load bearing surface, which provides an abutment surface.

* * * * *